US007080792B2

(12) United States Patent
Muratsubaki et al.

(10) Patent No.: US 7,080,792 B2
(45) Date of Patent: Jul. 25, 2006

(54) LIQUID PRESSURIZING DEVICE

(75) Inventors: Ryoji Muratsubaki, Toyama (JP); Osamu Honokidani, Toyama (JP); Masanori Takimae, Toyama (JP); Tadashi Sugimori, Toyama (JP)

(73) Assignee: Sugino Machine Limited, Toyama (JP)

( * ) Notice: Subject to any disclaimer, the term of this patent is extended or adjusted under 35 U.S.C. 154(b) by 0 days.

(21) Appl. No.: 10/799,385

(22) Filed: Mar. 11, 2004

(65) Prior Publication Data

US 2004/0217191 A1 Nov. 4, 2004

Related U.S. Application Data

(63) Continuation of application No. 09/889,550, filed as application No. PCT/JP00/00080 on Jan. 11, 2000, now abandoned.

(30) Foreign Application Priority Data

Jan. 21, 1999 (JP) ..... 11-012857

(51) Int. Cl.
*A01G 27/00* (2006.01)

(52) U.S. Cl. ..... 239/67; 239/69; 239/68; 239/373; 417/44.2; 417/418; 417/539

(58) Field of Classification Search ..... 239/67, 239/68, 69, 373; 417/44.2, 418, 536
See application file for complete search history.

(56) References Cited

U.S. PATENT DOCUMENTS 2,819,835 A * 1/1958 Newhall ..... 417/346
4,921,306 A * 5/1990 Tomlin ..... 299/17
5,106,268 A * 4/1992 Kawamura et al. ..... 417/45
5,114,314 A 5/1992 Fujimoto
5,120,199 A 6/1992 Youngs et al.
5,281,100 A * 1/1994 Diederich ..... 417/18
5,490,383 A 2/1996 Muller et al.
6,068,448 A * 5/2000 Muratsubaki et al. ..... 417/44.2

FOREIGN PATENT DOCUMENTS

| | | |
|---|---|---|
| JP | 62-147068 | 7/1987 |
| JP | 64-45984 | 2/1989 |
| JP | 4-329355 | 11/1992 |
| JP | 5-10274 | 1/1993 |
| JP | 7-151051 | 6/1995 |
| JP | 9-264261 | 10/1997 |
| JP | 10-156723 | 6/1998 |

* cited by examiner

*Primary Examiner*—David A. Scherbel
*Assistant Examiner*—James S. Hogan
(74) *Attorney, Agent, or Firm*—Frishauf, Holtz, Goodman & Chick, P.C.

(57) ABSTRACT

A liquid pressuring device comprises a reciprocating pump (1), pressure sensor (23) and pressure control unit (25) which is adapted to control the motion of the plungers (5A, 5B) so as to make an actual delivery pressure value reach a predetermined threshold and, after reaching the threshold, control the actual delivery pressure value so as to determine an optimum feed rate, and thereafter maintain the feed rate of the plungers constant at the optimum feed rate. The pressure control means (25) may include a proportional control element for performing, after the actual delivery pressure value has reached the threshold, the proportional control of the actual delivery pressure value during a time until the plungers (5A, 5B) first reach the forward stroke end thereof.

11 Claims, 10 Drawing Sheets

LIQUID PRESSURIZING DEVICE

This application is a Continuation of U.S. application Ser. No. 09/889,550 filed Aug. 30, 2001 now abandoned, which is a U.S. National Phase Application under 35 USC 371 of International Application PCT/JP00/00080 (not published in English) filed Jan. 11, 2000.

TECHNICAL FIELD

The present invention relates to a liquid pressurizing device utilizing a reciprocating pump such as a plunger pump and more particularly to a pressure control of a high pressure liquid delivered from the pump.

BACKGROUND ART

With the control of a delivery pressure of a high pressure liquid delivered from an electrically-operated reciprocating plunger pump employing a servo motor or the like as a driving source, it has been the common practice to effect the control by controlling a feed rate of the plungers reciprocating within the cylinder.

As a first method for such pressure control of a high pressure liquid, a method has been known widely in which an actual delivery pressure value detected by a pressure sensor mounted on the plunger pump is fed back so that its deviation from a preset pressure value as the desired value is determined and converted to a speed signal thereby adjusting the rotational speed of the servo motor or the feed rate of reciprocating motion of the plungers by a proportional-plus-integral control (PID control) based on the deviation so as to make the actual delivery pressure value coverage to the desired value.

On the other hand, a second method is such that the control is effected by an ON-OFF control in which while repeating start and stop of the servo motor, the feed rate of reciprocating motion of the plungers is varied so as to feed back and converge the actual delivery pressure value to a preset pressure value.

However, these conventional pressure control methods have the following problems. Where the pressure control is effected by the PID control, due to the nature of the PID control, the control readily and acutely responds to disturbances causing rapid acceleration and deceleration of the reciprocating motion of the plungers. Particularly, there is a problem that since the plunger stroke length of the plunger pump is short, a longer time is required until the actual delivery pressure value reaches a stable state even though acceleration and deceleration are effected frequently. Another problem is that since the control tends to be easily affected by disturbances, even after its stabilization, the actual delivery pressure value tends to vary easily and it is difficult to maintain a constant pressure value.

On the other hand, the pressure control method by the ON-OFF control has a problem that the direction of stroke of the plungers repeatedly in a complicated manner due to frequent start and stop of the servo motor and thus the maintenance of a pressure value at a constant value cannot be expected after its stabilization. There is another problem that the complicated start and stop of the servo motor has the effect of increasing the mechanical burden on the driving system including the belt, pulleys, etc., and reducing the life of the device.

It is to be noted that in a reciprocating pump such as a plunger pump, its delivery pressure of a high pressure liquid will be determined unambiguously by a feed rate of the reciprocating plungers if the nozzle diameter is fixed. Thus, if the feed rate of the plungers can be maintained constant, the delivery pressure value can also be maintained in a stable state.

DISCLOSURE OF INVENTION

In view of the foregoing deficiencies, it is the primary object of the present invention to provide a liquid pressurizing device capable of converging its delivery pressure value to the desired pressure value in a short period of time with a high degree of accuracy through a stable operation. It is another object of the present invention to provide a liquid pressurizing device capable of maintaining its delivery pressure at the desired pressure value in a stable state. It is still another object of the present invention to provide a liquid pressurizing device capable of reducing mechanical burdens on the device. It is still another object of the present invention to provide a liquid pressurizing device capable of improving the follow-up characteristics of its delivery pressure value to maintain the delivery pressure value at the desired preset pressure value in a stable state. It is still another object of the present invention to provide a liquid pressurizing device capable of readily controlling its actual delivery pressure value even in the case including a plurality of nozzles.

According to a preferred aspect of the present invention, there is provided a liquid pressurizing device including a reciprocating pump for pressurizing and delivering a high pressure liquid by reciprocating motion of plungers, pressure measuring means for measuring an actual delivery pressure value of the high pressure liquid, and pressure control means for adjusting the feed rate of the reciprocating motion of the plungers to control so that the actual delivery pressure value measured by said pressure measuring means is converged to a preset pressure value as a desired value, wherein the pressure control means is adapted to control the reciprocating motion of the plungers so as to make the actual delivery pressure value reach a predetermined threshold and, after reaching the threshold, control the actual delivery pressure value so as to determine an optimum feed rate, and thereafter maintain the feed rate of the reciprocating motion constant at said optimum feed rate.

In the present invention, the pressure control means first causes the actual delivery pressure value to reach the predetermined threshold for the delivery pressure and, after reaching the threshold, performs the control of the actual delivery pressure value.

Here, the predetermined threshold is one which is close to the preset pressure value as the desired value. In other words, according to the present invention, since the actual delivery pressure value can be caused to reach at once the threshold which is nearly equal to the desired value so that thereafter a feedback control of the actual delivery pressure value can be effected in the vicinity of the desired value so as to converge it to the desired value, the delivery pressure value can be caused to reach the desired value in a short period of time as compared with the conventional devices of the types in which the acceleration and deceleration of the plungers or the changing of the stroke direction of the plungers is repeatedly controlled over the whole range by the PID control or the ON-OFF control.

While there is no particular limitation to the feed rate for moving the plungers until the threshold is reached, it is preferable that the feed rate is the maximum feed rate for the plungers in order that the delivery pressure value can be converged to the desired value in a shorter period of time.

In this connection, it is suffice that the threshold is a pressure value which is nearly equal to the desired value and it can be predetermined as desired depending on such conditions as the plunger feed rate, the stroke length, etc. Also, as the threshold values, an upper limit value is predetermined in addition to the lower limit value. In this case, there is the advantage that since the gradually decelerating plungers tend to move even after the preset pressure value or the desired value has been reached, it is possible to prevent the movement of the plunger from stopping at the time that the actual delivery pressure value reaches the preset pressure value or the desired value.

Further, in accordance with the present invention the pressure control means is designed so that after the actual delivery pressure value has reached the threshold, the actual delivery pressure value is controlled so as to determine an optimum feed rate and thereafter the feed rate of the reciprocating motion is maintained constant at said optimum feed rate.

Here, the optimum feed rate is the feed rate of the plungers substantially corresponding to the preset pressure value or the desired value and a correction can be provided later in order to attain a complete coincidence between the plunger feed rate and the desired value. More specifically, according to the present invention, by making use of the fact that the delivery pressure of a high pressure liquid from the reciprocating pump can be determined by the feed rate of the plungers if the nozzle diameter is constant, the feed rate at the time that the actual delivery pressure is converged to the desired value by the pressure control after the threshold has been reached or the feed rate resulting in a pressure value nearly equal to the desired value is determined as the optimum feed rate and thereafter the feed rate of the reciprocating motion is maintained at a constant rate corresponding to this optimum feed rate. As a result, when the actual delivery pressure value is substantially converged to the desired value, it is maintained at a constant value with the result that the need for acceleration and deceleration of the plungers due to the effect of disturbances is eliminated and it is also unnecessary to effect any redetermination of the optimum feed rate in contrast to the conventional device which effects the pressure control by the PID control. Thus, the actual delivery pressure value can be caused to reach the desired value with a high degree of accuracy and smoothly. In addition, the maintenance of the actual delivery pressure at the desired value can be made easy and the stability can be improved.

According to a preferred embodiment of the present invention, the pressure control means comprises a proportional control means for performing, after the actual delivery pressure value has reached the threshold, the proportional control of the actual delivery pressure value during a time until the plungers first reach the forward stroke end thereof.

In this case, after the actual delivery pressure value has reached the threshold, the pressure control of the plungers up to the time that the plungers first reach the forward stroke end thereof is effected by the proportional control which is less responsive to disturbances so that the pressure value can be converged to a value nearly equal to the desired value in a shorter period of time even in the case of the plungers which are short in stroke length.

According to another embodiment of the present invention, after the optimum feed rate has been determined, the pressure control means corrects the feed rate on the basis of the deviation between the actual delivery pressure value and the preset pressure value when the direction of the reciprocating motion of the plungers is changed.

In this case, after the determination of the optimum feed rate, the feed rate of the plungers is corrected according to the deviation between the actual delivery pressure value and the preset pressure value when the direction of the reciprocating motion is changed so that even if the optimum feed rate is not a feed rate completely corresponding to the preset pressure value, the feed rate can be gradually converged in the course of the following reciprocating motion. In other words, by repeating the correction of the feed rate in the vicinity of the desired value, it is possible to converge the actual delivery pressure value to the desired value in a still shorter period of time. In addition, the feed rates before and after the correction are each maintained constant so that the device can be operated stably and the mechanical burden of the device can also be reduced. Further, even in the event that the feed rate varies and hence the actual delivery pressure value of the high pressure liquid varies due to a change in the direction of reciprocating motion, a correction can be provided so as to adjust the feed rate back to the optimum feed rate and thus the steady-state characteristics of the actual delivery pressure value can be made more satisfactory.

With the correction of the feed rate by the pressure control means of the present invention, there is no particular limitation to its construction provided that the correction is effected whenever the direction of reciprocating motion is changed. For instance, the pressure control means can be so constructed that a correction value calculated from a predetermined computational formula in accordance with each deviation of the actual pressure value from the preset pressure value is added to or subtracted from the feed rate or alternatively a correction value determined for each deviation amount in question is added to or subtracted from the feed rate.

Also, in addition to the case of effecting the correction each time the direction of reciprocating motion is changed at one or the other of the stroke ends, the correction can be effected separately when the direction of reciprocating motion is changed at each of the stroke ends. In this case, any error in the feed rate due to a leftward or rightward mechanical shift of the plungers can be eliminated thus making it possible to maintain excellent steady-state characteristics.

According to still another embodiment of the present invention, after the determination of the optimum feed rate, the pressure control means temporarily sets the feed rate to a rate which is higher than the said optimum feed rate when the direction of reciprocating motion of the plungers is changed.

In this case, after the determination of the optimum feed rate, the feed rate is temporarily set to a rate which is higher than the optimum feed rate when the direction of reciprocating motion of the plungers is changed and thus it is possible to prevent the actual delivery pressure value from lowering due to any pulsation caused by a change in the direction of the reciprocating motion thereby improving the damping characteristics and maintaining the stability. Such set rate may for example be the maximum feed rate so as to further improve the damping characteristics.

As described hereinabove, the liquid pressurizing device of the present invention is excellent in that the actual delivery pressure value of the plunger pump can be converged to the desired or the preset pressure value in a short period of time and also the stable state can be maintained after the convergence. However, where an ON-OFF valve is mounted on the nozzle so that switching between the injection and injection suspension of a high pressure liquid jet from the nozzle is effected frequently, pressure variations are increased. In other words, the pressure variations include the pressure variations caused by the injection of a high pressure water from the nozzle in addition to those due to the movement of the plungers and therefore, considering this fact, the upper limit threshold value must be preset to have a sufficient difference from the desired or the preset pressure value. As a result, when the feed of the plungers is stooped, the difference between the preset pressure value and the upper limit threshold value results in an overshoot thereby increasing the pressure variations.

Thus, in accordance with another aspect of the present invention, there is provided a liquid pressurizing device having a reciprocating pump for pressurizing and delivering a high pressure liquid through the reciprocating motion of its plungers, pressure measuring means for measuring an actual delivery pressure value of the high pressure liquid, a nozzle for injecting the high pressure liquid, pressure control means for adjusting the feed rate of reciprocating motion of the plungers to control so that the actual delivery pressure value measured by the pressure measuring means is converged to the preset pressure value as the desired value, and detecting means for detecting injection state and suspension state of the high pressure liquid from the nozzle, wherein the pressure control means is responsive to the detection of the suspension state by said detection means to stop the movement of the plungers when the preset pressure value is nearly reached.

In this case, since the movement of the plungers is stopped by the pressure control means in the vicinity of the present pressure value upon detection of the suspension state by the detecting means, when the injection of the high pressure liquid from the nozzle is stopped, there is no danger of the actual delivery pressure value becoming unnecessarily higher than the preset pressure value as the desired value thereby minimizing the overshoot from the preset pressure value and improving the follow-up characteristics. As a result, there is no danger of causing pressure variations due to the effect of the injection pressure of the high pressure liquid from the nozzle and the delivery pressure value can be made more stable.

Here, the values nearly equal to the preset pressure value include not only the preset pressure value as the desired value but also the given threshold values preset close to the preset pressure value. However, in order to improve the follow-up characteristics of the delivery pressure value, it is preferable that they differ only slightly from the preset pressure value.

The pressure control means of the present invention is not particularly limited in construction provided that the movement of the plungers is stopped at a value nearly equal to the preset pressure value when the suspension state of the injection is detected. For example, it is arbitrary for the pressure control means to control so that when a reinjection is detected by the detecting means, the plungers are moved at the maximum feed rate until the preset pressure value is reached and, after reaching it, the plungers are moved at a given optimum feed rate. In this case, a decrease from the preset pressure value as the desired value can be minimized by the pressure control means.

Note that the detecting means of the present invention may for example be comprised of a sensor or the like which detects opening and closing of the ON-OFF valve mounted on the nozzle.

According to a preferred embodiment of the present invention, the pressure control means is adapted to control the reciprocating motion of the plungers so as to make the actual delivery pressure value reach a predetermined threshold and, after reaching the threshold, control the actual delivery pressure value so as to determine an optimum feed rate, and thereafter maintain the feed rate of the reciprocating motion constant at said optimum feed rate, whereas the pressure control means is responsive to the detection of the suspension state by said detectiong means to stop the movement of the plungers and also responsible to the detection of a reinjection by said detecting means to effect the movement of the plungers at the optimum feed rate. The reinjection may be descriminated by the control means in accordance with the detection of the injection state after detection of the suspension state by the detecting means.

The present invention is applied to a liquid pressurizing device of the type described in which a threshold is predetermined so that after the actual delivery pressure value has reached the threshold, an optimum feed rate is determined and the feed rate of the plungers is maintained constant at the optimum feed rate. More specifically, according to the present invention, in addition to the advantage that the actual delivery pressure value can be caused to reach a preset pressure value (the desired value) in a short period of time and then the stability can be maintained, when the suspension state of injection is detected by the detecting means, the pressure control means stops the movement of the plungers when the delivery pressure value is nearly equal to the preset pressure value (the desired value) after it has reached the threshold. Thus, it is possible to minimize the overshoot from the preset pressure value, to improve the follow-up characteristics to reduce the pressure variations due to the injection stopping and to stabilize the delivery pressure value further.

In addition, since the pressure control means moves the plungers at the optimum feed rate when a reinjection is detected by the detecting means, there is an advantage that the plungers can be returned to the optimum feed rate immediately after the reinjection, that decreasing of the actual delivery pressure value from the preset pressure value (the desired value) can be minimized to further reduce the pressure variations and that the actual delivery pressure value can be stabilized.

Although there is no particular limitation to the feed rate for the plunger movement until the threshold is reached, it should preferably be the maximum feed rate for the plungers in order to improve the response characteristics of the pressure control and to converge the actual delivery pressure value to the preset pressure value in a shorter period of time.

It is to be noted that while the threshold is only required to represent a pressure value near to the preset pressure value, the difference between it and the preset pressure value should preferably be as small as possible in order to maintain the follow-up characteristics. In addition, both upper and lower limit values may be preset as threshold values.

The optimum feed rate is a plunger feed rate substantially corresponding to the preset pressure value or the desired value and it may be constructed so that it can be corrected later so as to be in complete coincidence with the present pressure value.

With the pressure control means of the present invention, the control of the actual delivery pressure value effected after reaching the threshold is not limited in construction provided that the optimum feed rate of the plungers can be determined. While the PID control can be used as such control, it is preferable to perform the proportional control with a view to reducing the effect of disturbances and converging the actual delivery pressure value to near the preset pressure value in a shorter period of time even in the case of plungers which are short in stroke length.

Also, the convergence to the preset pressure value can be effected more rapidly by constructing so that the optimum feed rate is determined by performing such proportional control during the time that the plungers first reach the forward ends thereof after the actual delivery pressure value has reached the threshold.

According to still another aspect of the present invention, there is provided a liquid pressurizing device having a reciprocating pump for pressurizing and delivering a high pressure liquid through the reciprocating motion of a plurality of plungers, pressure measuring means for measuring the actual delivery pressure value of the high pressure liquid, a plurality of nozzles for injecting the high pressure liquid, pressure control means for adjusting the feed rate of reciprocating motion of the plungers to control so that the actual delivery pressure value measured by said pressure measuring means is converged to a preset pressure value as a desired value, and detecting means for detecting injection state and suspension state of the high pressure liquid from each of the nozzles, wherein the pressure control means is adapted to control the reciprocating motion of said plungers so as to make the actual delivery pressure value reach a predetermined threshold and, after reaching said threshold, control the actual delivery pressure value so as to determine an optimum feed rate corresponding to the injection state or suspension state of each of the nozzles, and thereafter maintain the feed rate of the reciprocating motion constant at said optimum feed rate, whereas the pressure control means is responsive to the detection of any change between said injection state and suspension state of each of the nozzles by the detectiong means so that the feed rate of the reciprocating motion of the plungers is changed to the optimum feed rate corresponding to the injection state or suspension state of each of the nozzles after the change between the injection state and suspension state.

The present invention is applied to the liquid pressurizing device including the plurality of nozzles so as to inject a high pressure liquid from each of the nozzles.

Then, in the case where a plurality of nozzles are used, the pressure varies depending on the combination of injection state and suspension state of the nozzles and the optimum feed rate of plungers also varies according to different states thus making the control difficult; in accordance with the present invention, however, when the detecting means detects a change between the injection state and suspension state of each of the nozzles, the pressure control means changes the current optimum feed rate to an optimum feed rate corresponding to the injection state or suspension state of the nozzles following the said change of state with the result that the optimum feed rate that suits the injection state or suspension state of the nozzles can be maintained at all times and that any pressure change of the actual delivery pressure value can be prevented to maintain its stabilized state.

According to the present invention, the injection state and suspension state of the nozzles mean that if the number of the nozzles is two, for example, three different combinations are conceivable including one in which one of the nozzles is in the injection state and the other is in the suspension state, another in which these states are reversed and still another in which the nozzles are both in the injection state. Thus, in this case three different optimum feed rates of the plungers will be determined so as to suit the respective combinations of states.

Also, in addition to predetermining the optimum feed rates corresponding to the injection/injection states of the nozzles, they may be determined according to the control performed after the actual delivery pressure value has reached the threshold. In this case, the optimum feed rate corresponding to the actual injection conditions of the nozzles can be determined and therefore there is the advantage that the stability for the control of the actual delivery pressure value can be improved further.

BEST MODE FOR CARRYING OUT THE INVENTION

Figure 1:
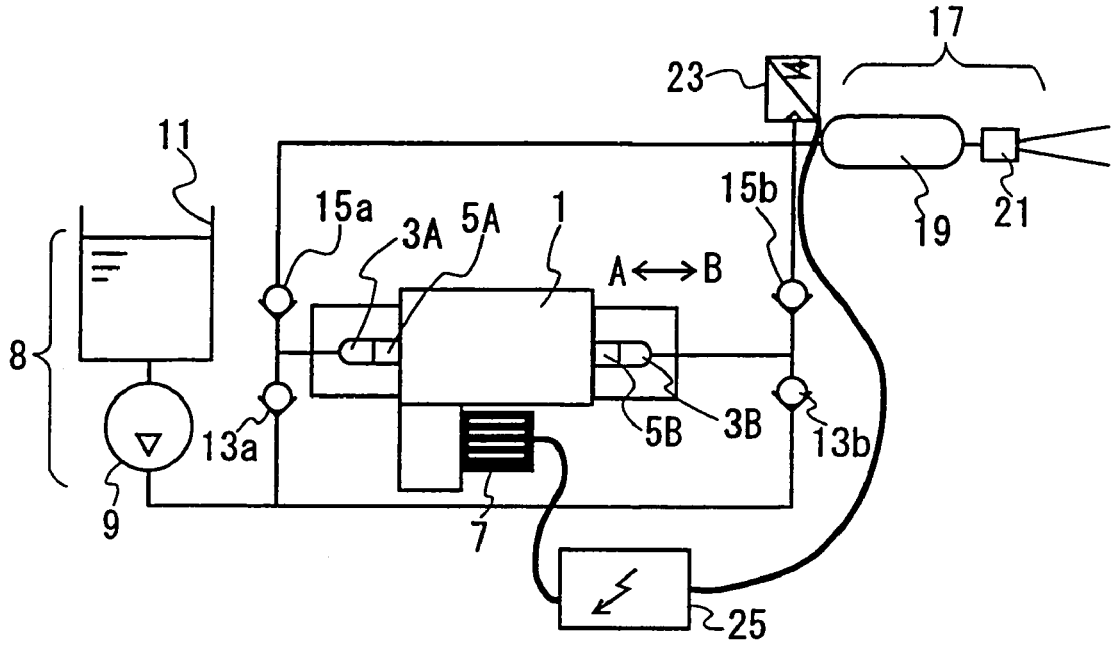
FIG. 1 is a schematic block diagram of a liquid pressurizing device according to a first embodiment of the present invention.

The present invention will now be described in greater detail with reference to its embodiments. FIG. 1 is a schematic block diagram of a liquid pressurizing device according to a first embodiment of the present invention. The liquid pressurizing device according to this embodiment is shown as applied to a nozzle device adapted, for example, to cut materials through the injection of a high pressure liquid.

FIG. 1 shows a hydraulic circuit diagram and the liquid pressurizing device includes mainly a liquid supply source 8, a plunger pump 1 as a reciprocating pump, a control unit 25 as pressure control means, a pressure sensor 23 as pressure measuring means and an injection unit 17.

The liquid supply source 8 supplies a liquid to the plunger pump 1 and it includes a hydraulic liquid tank 11 and a liquid supply pump 9.

The liquid in the tank 11 is delivered to the plunger pump 1 so that it is pressurized and then injected to the outside through the injection unit 17. As to the liquid, various kinds of liquids can be suitably selected according to the cases where the liquid is used for the cutting of materials, where the liquid is used for pressure treatments of foodstuffs and so on.

The pump 9 is provided for supplying such liquid at a predetermined pressure to the plunger pump 1 and it may be a rotary pump or reciprocating pump provided that the liquid can be supplied continuously. Note that the plunger pump 1 can be caused to self-suck the liquid in the tank 11 without the provision of the pump 9.

The plunger pump 1 includes a servo motor 7 and plungers 5A and 5B which are driven by the servo motor 7. The plungers 5A and 5B have stroke lengths equal to each other and are reversibly operable in association with each other so as to reciprocate as a unit and thereby to effect a so-called push-pull operation in left and right pump chambers 3A and 3B of the plunger pump 1 in which one of the plungers performs the delivery stroke when the other is on the suction stroke. In other words, the plunger 5B sucks the liquid into the pump chamber 3B by moving in the direction of an arrow A shown (the suction stroke) and discharges the liquid sucked by the suction stroke by conversely moving in the direction of an arrow B (the delivery stroke). Note that in the case of the plunger 5A, respective strokes in the directions of the arrows A and B are reverse to those in the case of the plungers 5B.

Then, since the first embodiment uses the plunger pump 1 associated with the servo motor 7, the control is made easy.

The pressure sensor 23 measures the actual-delivery pressure of the high pressure liquid discharged from the plunger pump 1 and the measured result is inputted as an electric signal to the control unit 25. The pressure sensor constitutes pressure measuring means in the first embodiment.

The plunger pump 1 delivers the high pressure liquid to the injection unit 17, and the delivery pressure of the high pressure liquid is determined by the feed rate of the reciprocating motion in the suction and delivery strokes of the plungers 5A and 5B. Then, this feed rate is determined by the control part 25, which controls the rotational speed of the servo motor 7, in accordance with a feedback control based on the signal inputted to the control unit 25 from the pressure sensor.

Figure 2:
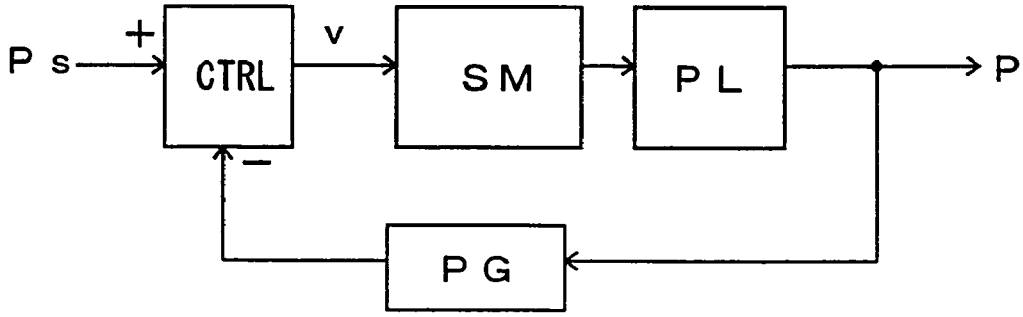
FIG. 2 shows a control block diagram for the liquid pressurizing device of the first embodiment.

FIG. 2 shows a control block diagram of the pressure control system in the liquid pressurizing device of the first embodiment. Here, in FIG. 2 CTRL represents the control unit 25, SM the servo motor 7, PL the plungers 5A and 5B, PG the pressure sensor 23, v a speed command signal to the servo motor (SM) 7, Ps a preset pressure value as the desired value, and P the actual delivery pressure value.

The control unit (CTRL) 25 receives the preset pressure value Ps and the actual delivery pressure value P fed back from the pressure sensor (PG) 23. Then, in accordance with the deviation between the preset pressure value Ps and the actual delivery pressure value P the required feed rate of the plungers (PL) 5A and 5B is calculated by the control method which will be described later and it is outputted as a speed command signal v to the servo motor (SM) 7. Thus, the servo motor 7 is rotated at a rotational speed corresponding to the speed command signal v. Therefore, the feed rate of the plungers 5A and 5B which is based on the actual delivery pressure value, is controlled by the control unit 25 and hence the control of the delivery pressure of the high pressure liquid is performed.

Check valves 13*a* and 13*b* are disposed on the liquid supply part 8 side (upstream portions) of the flow passages connected to the plunger pump 1 and check valves 15*a* and 15*b* are also disposed on the injection unit 17 side (downstream portions) of these flow passages. The check valves 13*a* and 13*b* only permit the liquid to free-flow into the plunger pump 1 from the liquid supply part 8 and the check valves 15*a* and 15*b* only allow the liquid to free-flow out to the injection unit 17 from the plunger pump 1. Both of these valves are arranged in such directions that any reverse flow from the downstream side to the upstream side is prevented.

The high pressure liquid from the plunger pump 1 is delivered to the injection unit 17 through the check valves 15*a* and 15*b*. The injection unit 17 comprises a pressure accumulator 19 and an injection nozzle 21.

The accumulator 19 is connected to the nozzle 21 to relieve momentarily variations in the delivery rate and/or the delivery pressure of the high pressure liquid from the nozzle 21.

Figure 3A:
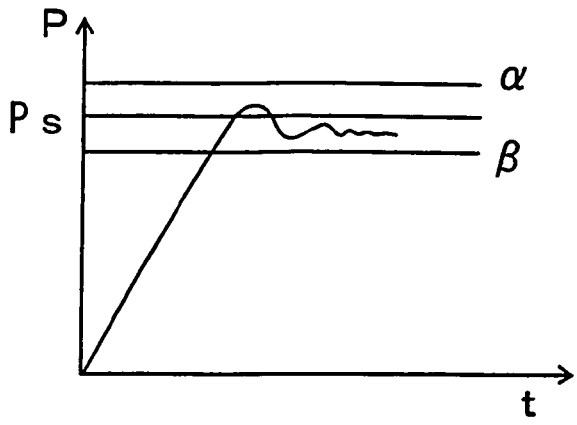
FIG. 3*a* is an operating state diagram showing variations of the actual delivery pressure value in the first embodiment.
Figure 3B:
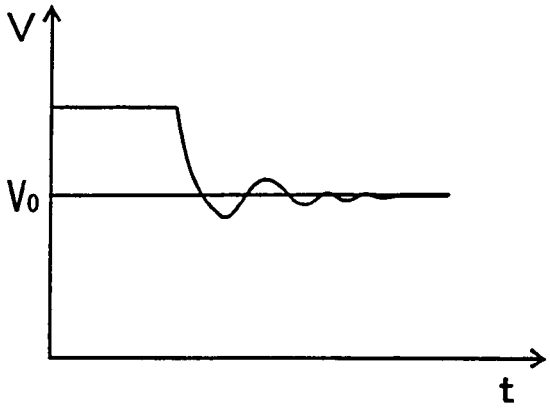
FIG. 3*b* is an operating state diagram showing variations in the feed rate of the plungers in the first embodiment.
Figure 5:
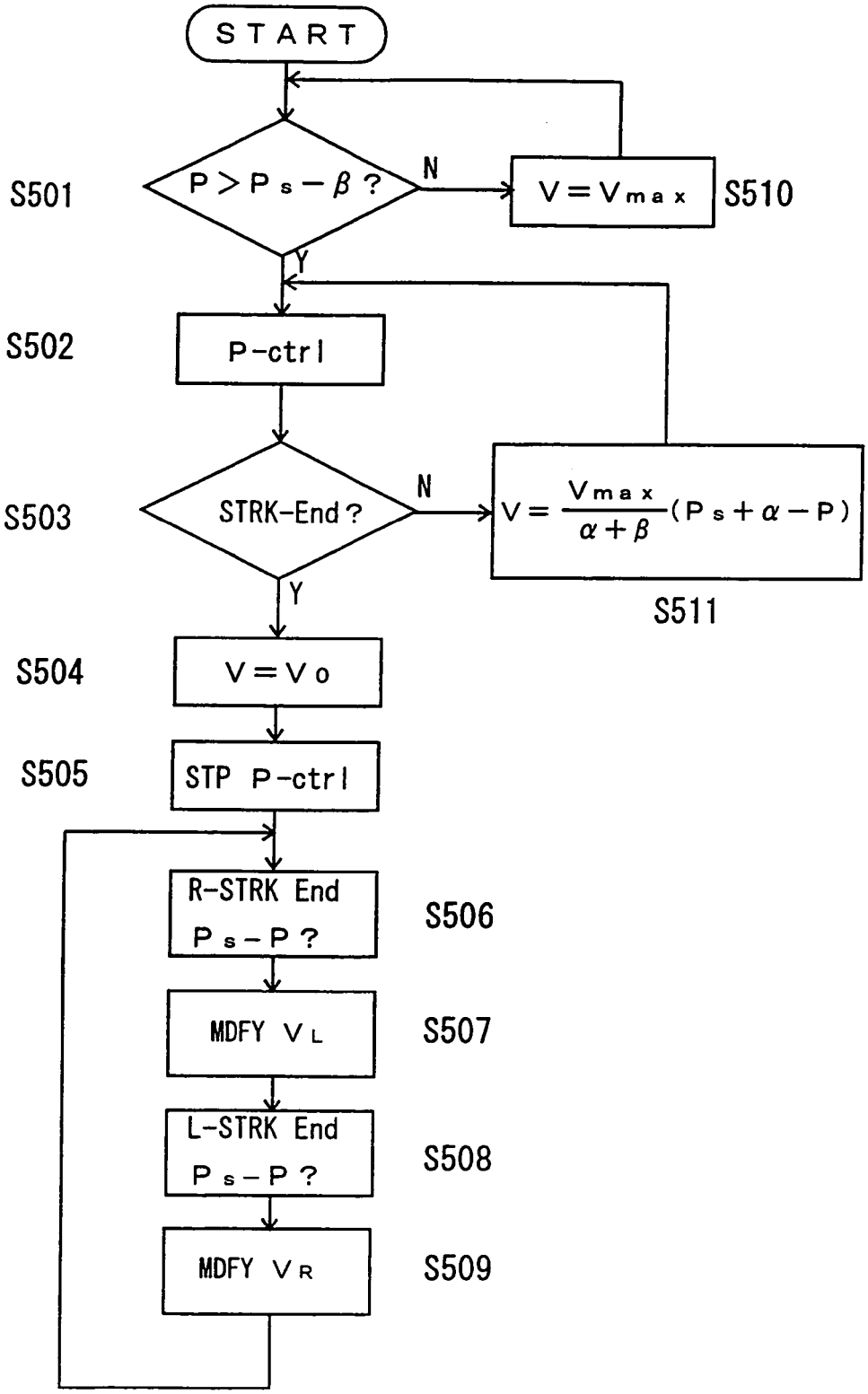
FIG. 5 shows a flow chart for the pressure control processing in the liquid pressurizing device of the first embodiment.

Next, the pressure control of the high pressure liquid by the control unit 25 of the liquid pressurizing device constructed as described hereinabove will be explained. FIG. 5 shows a flow chart of the pressure control in the first embodiment. Also, FIG. 3*a* is an operating state diagram of the the variation with time of the actual delivery pressure value P, and FIG. 3*b* is an operating state diagram of the variation with time of the feed rate V of the plungers 5A and 5B.

First of all, the preset pressure value Ps as the desired value and threshold values $\alpha$ and $\beta$ are preliminarily determined and inputted to the control unit 25. Here, the threshold value $\alpha$ is used as an upper limit value ($Ps+\alpha$) for the pressure value and the threshold value $\beta$ is used as a lower limit value ($Ps-\beta$) for the pressure value. Note that only a lower limit value may be preset as the threshold. Also, the threshold values $\alpha$ and $\beta$ are values which are close to the preset pressure value Ps as the desired value and they are respectively set to 5 MPa and 20 MPa in the first embodiment. It is to be noted that the threshold values $\alpha$ and $\beta$ are not limited to these values and they can be determined arbitrarily depending on such conditions as the stroke length of the plungers 5A and 5B, the preset pressure value, etc.

Then, the servo motor 7 is driven so that the plungers 5A and 5B make reciprocating motion. A feed rate V of the plungers 5A and 5B is determined by the following equations (1), (2) and (3).

| | | |
|---|---|---|
| $V = Vmax$ | (when $P < Ps - \beta$) | (1) |
| $V = Vmax\ (Ps + \alpha - P)/(\alpha + \beta)$ | (when $Ps - \beta \leqq P < Ps + \alpha$) | (2) |
| $V = 0$ | (when $Ps + \alpha \leqq P$) | (3) |

Here, Vmax is the maximum feed rate of the plungers 5A and 5B.

Thus, the actual delivery pressure value P is detected at intervals of a given time by the pressure sensor 23 to determine whether the actual delivery pressure value P has reached Ps−β (S501). Then, if the actual delivery pressure value P has not reached Ps−β, a speed command signal for causing the feed rate of the plungers 5A and 5B to become Vmax is sent to the servo motor 7 (S510).

If the actual delivery pressure value P has reached Ps−β, it is determined whether the plungers 5A and 5B are positioned at the stroke ends (STRK-End) (S503) so that if the plungers 5A and 5B are not at the stroke ends (STRK-End), a speed command signal is sent so as to cause the feed rate of the plungers 5A and 5B to assume the value calculated from the equation (2) (S511). In this case, during the time that the plungers 5A and 5B first reach the stroke ends (STRK-End), a proportional control (P-ctrl) of the actual delivery pressure value P is performed by the control part 25 (S502). In other words, since the actual delivery pressure is subjected to the proportional control when it is close to the preset pressure value Ps (the desired value), it tends to be converged to the desired value.

Then, as the plungers 5A and 5B are moved to the first stroke ends, the feed rate at the time of a change in the direction of movement of the plungers 5A and 5B is detected so that this feed rate is taken as the optimum feed rate Vo and the feed rate V is set to Vo (S504). At his time, the optimum feed rate Vo has a value which is very close to the feed rate corresponding to the preset pressure value Ps or the desired value.

Once the optimum feed rate Vo has been determined, the proportional control is stopped (STP P-ctrl, S505) and the feed rate V of the plungers 5A and 5B is maintained constant at Vo. However, when changing the direction of reciprocating motion at the stroke ends of the plungers 5A and 5B, the feed rate of the plungers 5A and 5B is temporarily set to the maximum feed rate Vmax. This is done for the purpose of preventing any lowering of the actual delivery pressure value P due to pulsations caused when changing the direction of movement of the plungers 5A and 5B and thus making excellent the damping characteristics of the control system and improving the stability.

More specifically, upon changing the direction of movement of the plungers 5A and 5B at the rightward stroke ends (R-STRK End) and the leftward stroke ends (L-STRK End) respectively, the actual delivery pressure value P and the preset pressure value (the desired value) Ps are compared to determine the deviation (Ps−P) (S506, S508). Also, during the time that the actual delivery pressure value P remains outside the range from the preset pressure value Ps to the preset pressure value Ps−2 MPa, the feed rate is controlled in such a manner that the feed rate V becomes the maximum feed rate Vmax. Then, when the pressure sensor 23 detects that the actual delivery pressure value P has again come into the range from the preset pressure value Ps to the preset pressure value Ps−2 MPa, the feed rate is returned to the optimum feed rate Vo. It is to be noted that the range of actual delivery pressure values to be set to the maximum feed rate is not limited to the outside of the range from the preset pressure value Ps to the preset pressure value Ps−2 MPa and any desired range can be arbitrarily determined in dependence on such conditions as the stroke length of the plungers 5A and 5B, the preset pressure value, etc.

Also, at the respective leftward and rightward stroke ends (L-STRK End, R-STRK End) of the plungers 5A and 5B, the rotation speed of the servo motor 7 is changed so as to add a value corresponding to 1/100 of the optimum feed rate Vo to the feed rate and thereby to correct the leftward feed rate $V_L$ and rightward feed rate $V_R$ for the plungers 5A and 5B (MDFY $V_L$, S507; MDFY $V_R$, S509).

It is to be noted that the feed rate is separately corrected at the respective leftward and rightward stroke ends of the plungers 5A and 5B for the purpose of eliminating an error in the feed rate due to mechanical shifting of the plungers 5A and 5B upon changing the direction of movement.

Figure 4:
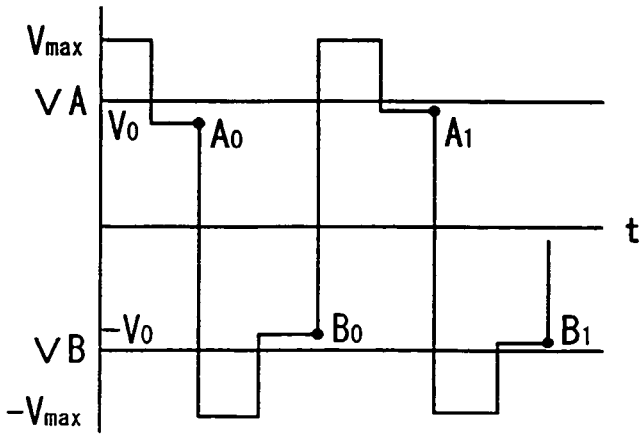
FIG. 4 is an operating state diagram showing variations in the feed rate at the respective stroke ends in the liquid pressurizing device of the first embodiment.

FIG. 4 is a diagram showing the manner in which the feed rate is changed at the stroke ends of the plungers 5A and 5B. Here, $V_A$ represents the desired value for the feed rate at the rightward stroke ends, and $V_B$ represents the desired value for the feed rate at the leftward stroke ends. As will be seen from FIG. 4, the feed rate V is changed to the maximum rate Vmax for a given period of time from the time of change in the direction of movement and it is changed to a corrected value $A_0$, $A_1$, $B_0$ or $B_1$ of the optimum feed rate Vo during the interval between the lapse of the said time period and the time of next change in the direction of movement.

On the other hand, while the control unit 25 maintains the feed rate at a constant value, if, in this case, the actual delivery pressure value P becomes higher than the preset pressure value Ps+α due to any cause, the plungers 5A and 5B are stopped. Alternatively, if the actual delivery pressure value P becomes lower than the preset pressure value Ps−β or the preset pressure value Ps−2β, a proportional control is again performed and an optimum feed rate Vo is determined. Thus, even if the actual delivery pressure value P varies considerably, it can be immediately returned to the steady state.

Figure 6:
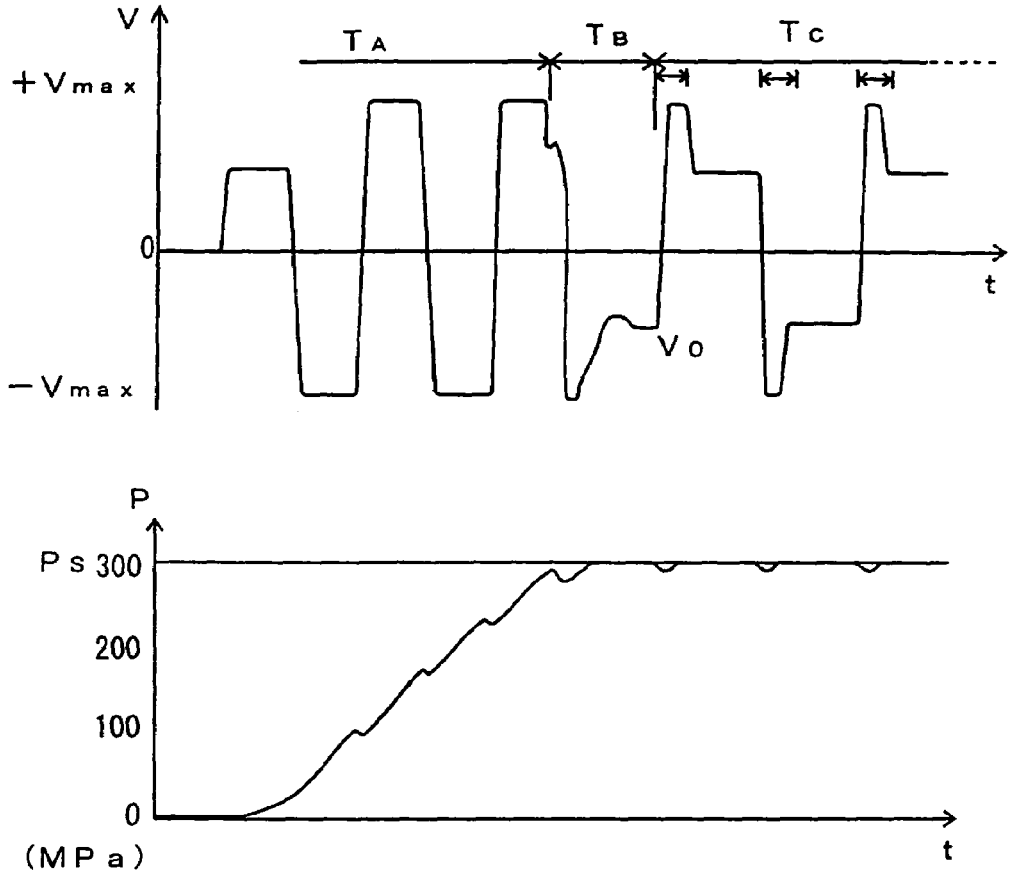
FIG. 6 is an explanatory diagram showing the measurement results of the plunger feed rate V and the actual delivery pressure value P in the first embodiment.

Then, FIG. 6 shows the measured results of the plunger feed rate V and the actual delivery pressure value P in terms of motor speeds in a case where the pressure control is effected with the nozzle diameter of 0.2 cm and the preset pressure value Ps of 300 MPa. Here, $T_A$ represents a time period for effecting a high speed feeding of the plungers, $T_B$ represents a time period for performing the proportional control and $T_C$ represents a time period for performing constant rate feeding of the plungers. As will be seen from FIG. 6, in accordance with the liquid pressurizing device of the first embodiment there is the effect of improving the steady-state characteristics, damping performance and stability of the actual delivery pressure value.

Figure 7:
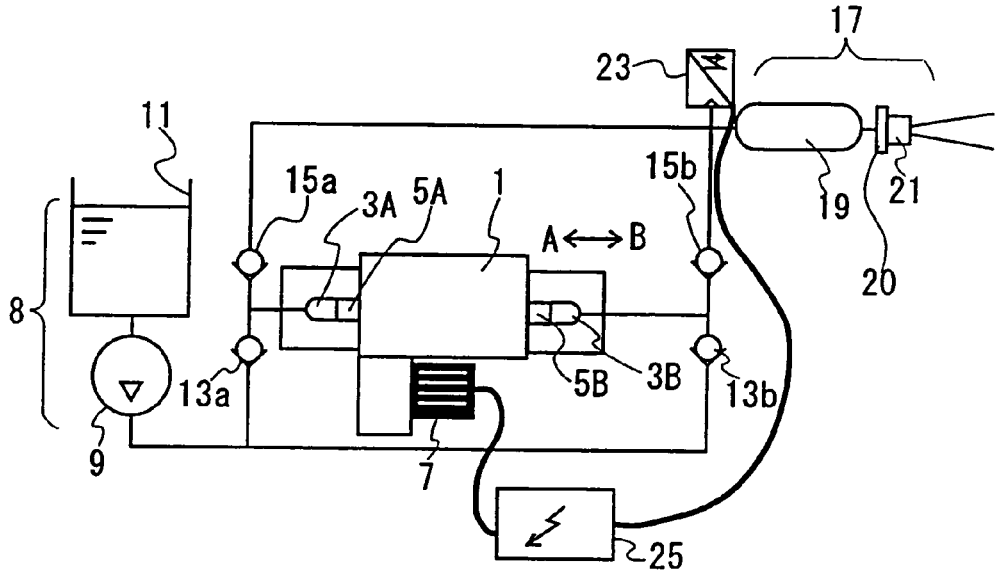
FIG. 7 is a schematic block diagram of a liquid pressurizing device according to a second embodiment of the present invention.

Next, a liquid pressurizing device according to a second embodiment will be described. FIG. 7 is a schematic block diagram for the liquid pressurizing device of the second embodiment.

As shown in FIG. 7, the liquid pressurizing device includes a liquid supply source 8, a plunger pump 1 as a reciprocating pump, a control unit 25 as pressure control means, a pressure sensor 23 as pressure measuring means, and an injection unit 17. The liquid supply source 8, the pressure sensor 23 and the plunger pump 1 are the same in construction with those of the first embodiment and therefore their details will not be explained.

The injection unit 17 includes a pressure accumulator 19, an ON-OFF valve 20 and an injection nozzle 21. Here, the accumulator 19, the nozzle 21, and check valves 13*a*, 13*b*,

15*a* and 15*b* are the same as in the first embodiment and thus their detaols will not be explained.

The ON-OFF valve 20 controls the injection and suspension of injection of the high pressure liquid from the nozzle 21 so that the high pressure liquid is injected in the ON-state thereof and the injection is stopped in the OFF-state thereof. The ON-OFF states of the ON-OFF valve 20 produces electrical signals corresponding to the injection state and suspension state respectively, and the signals are inputted to the control unit 25. That is, in this embodiment, the ON-OFF valve 20 constitutes detecting means of the present invention.

Figure 8:
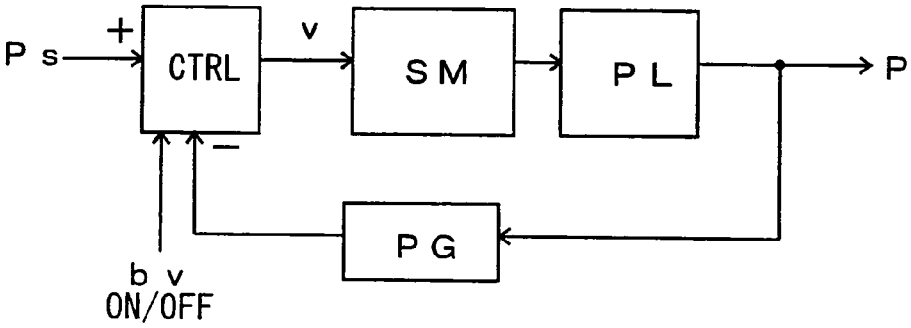
FIG. 8 shows a control block diagram of the liquid pressurizing device according to the second embodiment.

FIG. 8 shows a control block diagram of the pressure control system in the liquid pressurizing device according to the second embodiment. In the Figure, by denotes an ON/OFF signal from the ON-OFF valve 20. While the control unit (CTRL) 25 is adapted to control the feed rate of the plungers which is based on the actual delivery pressure value in the same manner as the control unit in the liquid pressurizing device of the first embodiment, it is also adapted to receive the signals from the ON-OFF valve 20. The remaining constitutional parts are the same as in the first embodiment so that they are designated by the same reference numerals as in FIG. 2 and will not be explained in detail.

Figure 9:
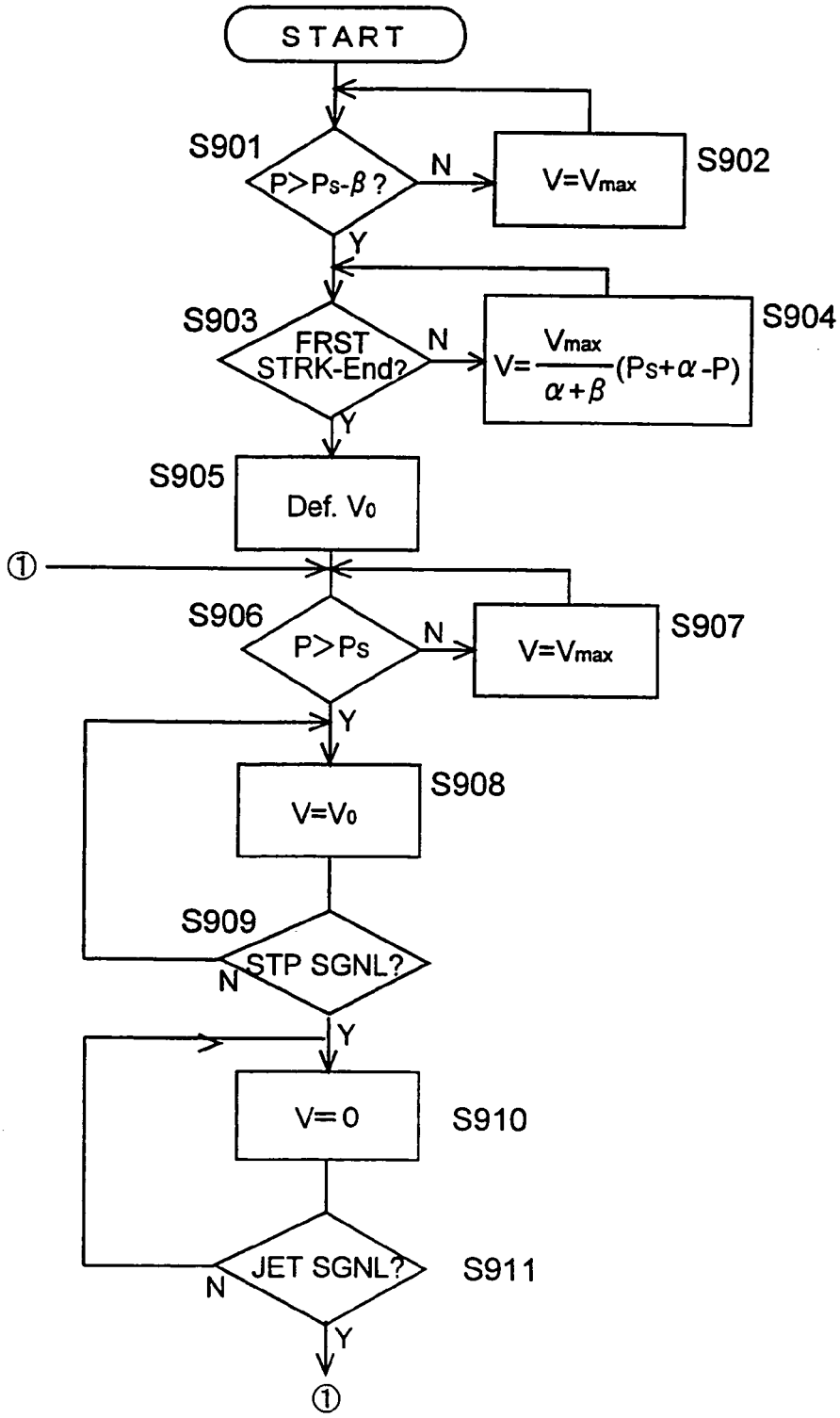
FIG. 9 shows a flow chart for the pressure control processing in the liquid pressurizing device of the second embodiment.
Figure 10A:
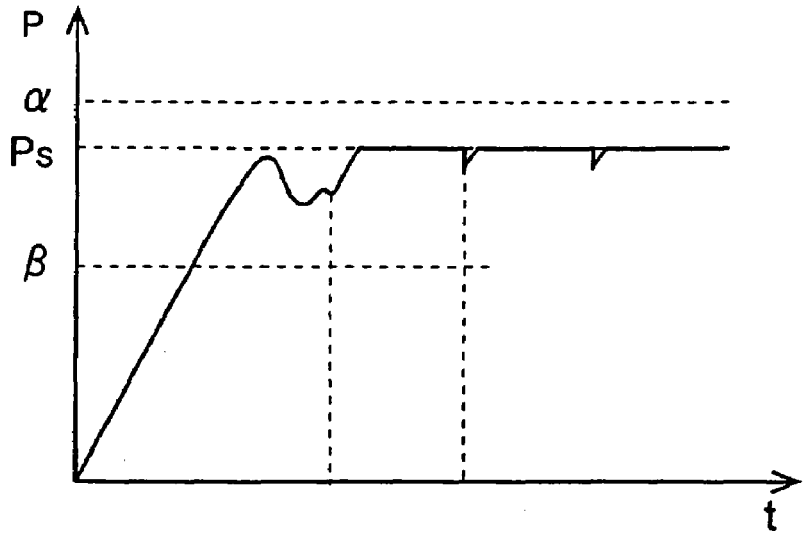
FIG. 10*a* is an operating state diagram showing variations in the actual delivery pressure value in the second embodiment.
Figure 10B:
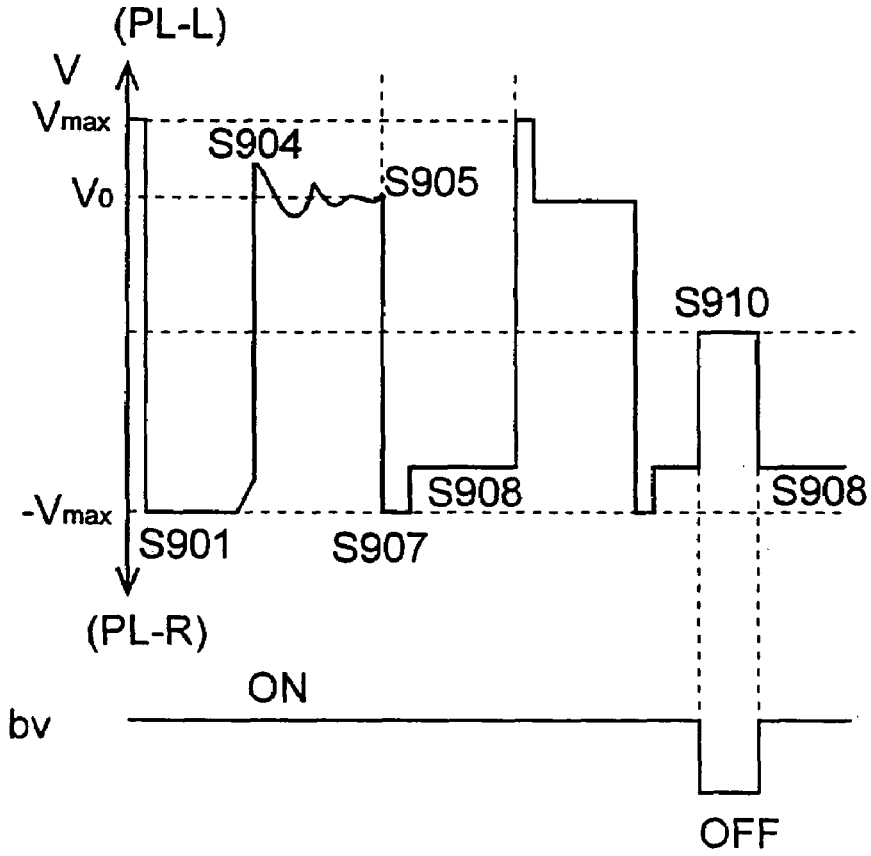
FIG. 10*b* is an operating state diagram showing variations in the feed rate of the plungers in the second embodiment.

Next, with the construction described above, the pressure control of the high pressure liquid by the control unit 25 of the liquid pressurizing device will be described. FIG. 9 shows a flow chart for the pressure control in the present embodiment FIG. 10*a* is an operating state diagram showing the time t and the variations of the actual delivery pressure value P, and FIG. 10*b* is an operating state diagram showing the time t and the variations of the feed rate V of the plungers 5A and 5B in correspondence to the respective steps in FIG. 9. Also, in FIG. 10*b* bv shows the changes with time of ON/OFF states of the ON-OFF valve. Here, in FIG. 10*b* the direction of PL-L on the ordinate shows the case in which the plungers are making leftward strokes and the direction of PL-R on the ordinate shows the case in which the plungers are making rightward strokes.

As in the first embodiment, a preset pressure value Ps and an upper limit value (Ps+α) and lower limit value (Ps−β) for pressure values are determined first and the plungers 5A and 5B are reciprocated at the feed rate V of the previously mentioned equation (1), (2) or (3).

Then, the actual delivery pressure value P is detected at intervals of a predetermined time by the pressure sensor 23 so that if the actual delivery pressure value P has not reached Ps−β as yet, the plungers 5A and 5B are moved at the feed rate of the maximum feed rate Vmax (S901, 902).

When the actual delivery pressure value P reaches Ps−β, the plungers 5A and 5B are each caused to make a single stroke movement, and a proportional control is performed, thus causing the feed rate of the plungers 5A and 5B to assume the value calculated from the equation (2) until the first stroke ends (FRST STRK-End) are reached (S903, S904).

When the plungers 5A and 5B reach the first stoke ends (FRST STRK-End), if the ON-OFF valve has not changed its state, the feed rate at the stroke ends is detected and it is determined ss the optimum feed rate Vo (Def. Vo, S905). At this time, the optimum feed rate Vo has a value which is very close to the feed rate corresponding to the preset pressure value Ps or the desired value and the proportional control is performed in the vicinity of the preset pressure value Ps (the desired value), thereby readily converging the actual delivery pressure value to the preset pressure value.

Next, it is determined whether the actual delivery pressure value P has reached the preset pressure value Ps as the desired value, so that if it is not, the feed rate of the plungers 5A and 5B is set to the Vmax of equation (1) (S907). Then, when the preset pressure value Ps is reached, the plungers are operated at the optimum feed rate Vo (S908).

During such operation of the plungers 5A and 5B at the optimum feed rate Vo, it is determined whether the ON-OFF valve has changed to its OFF-state and an injection stop signal (STP SGNL) has been inputted (S909), so that if it is, the feed rate V of the plungers 5A and 5B is set to 0 (zero) and the movement of the plungers is stopped (S910).

When the ON-OFF valve has again changed to the ON-state so that an injection signal (JET SGNL) has been inputted (S911) and the actual delivery pressure value P has reached the preset pressure value Ps, the plungers 5A and 5B are operated again at the optimum feed rate Vo (S906,908). On the other hand, if the actual delivery pressure value P has not reached the preset pressure value Ps, the plungers 5A and 5B are operated again at the maximum feed rate Vmax (S907), so that after the preset pressure value Ps has been reached, the feed rate V is maintained at the optimum feed rate Vo and the operation is continued (S906, 908).

Thus, with the liquid pressurizing device of the present embodiment, when the suspension state is detected, the movement of the plungers is stopped in the vicinity of the preset pressure value and there is no danger of the actual delivery pressure value unnecessarily exceeding the preset pressure value Ps upon the suspension of the injection of the high pressure liquid from the nozzle. As a result, the overshoot from the preset pressure value Ps can be minimized and the follow-up characteristics can be made excellent. In addition, upon changing from the suspension state to the injection state, the plungers can be moved at the optimum feed rate simultaneously or substantially simultaneously with the detection of injection state thereby readily obtaining the actual delivery pressure which is close to the preset pressure value.

On the other hand, when the ON-OFF valve is in the ON-state and the nozzle is injecting the high pressure liquid at the step 909 (when there is no injection stop signal STP SGNL), the feed rate of the plungers 5A and 5B is maintained at the optimum feed rate Vo (S908). However, when the direction of reciprocating motion is changed at the stroke ends of the plungers 5A and 5B, the feed rate of the plungers 5A and 5B is temporarily set to the maximum feed rate Vmax. This is for the purpose of preventing the actual delivery pressure value P from lowering due to pulsations upon changing the direction of movement of the plungers 5A and 5B and thereby making the follow-up characteristics of the control system excellent and improving the stability.

Note that in the like manner as the first embodiment, when the actual delivery pressure value P becomes higher than the preset pressure value Ps+α, the plungers 5A and 5B are stopped, whereas when it becomes lower than the preset pressure value Ps−β, the proportional control is performed again so as to determine an optimum feed rate Vo.

Next, a liquid pressurizing device according to a third embodiment will be explained. The liquid pressurizing device of the third embodiment includes a pair of nozzles 21 and a pair of ON-OFF valves 20 respectively corresponding to the former, and the remaining details will not be explained since they are similar to that in the embodiment of FIG. 7.

Figure 11:
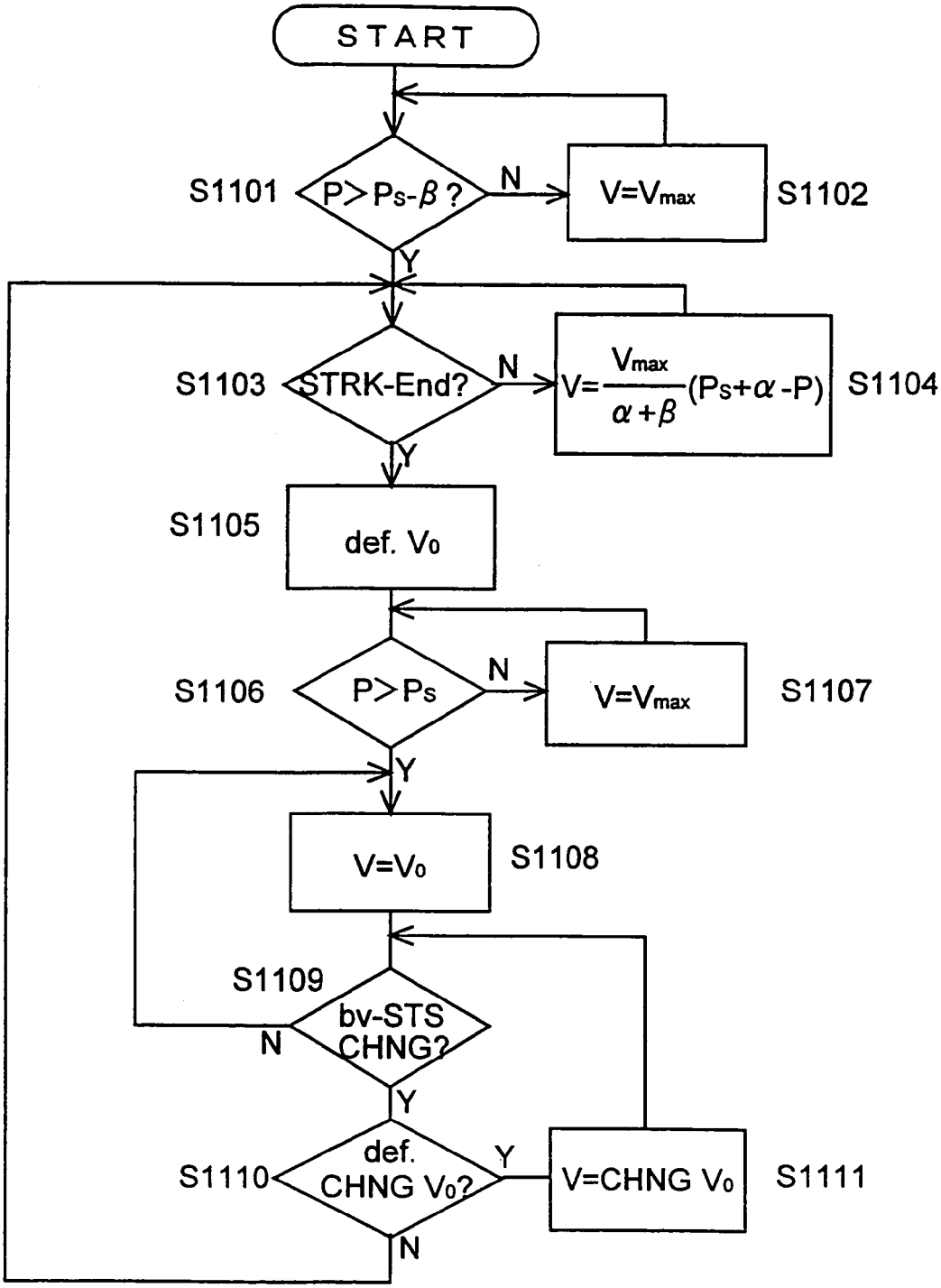
FIG. 11 shows a flow chart for the pressure control processing in a liquid pressurizing device according to a third embodiment of the present invention.
Figure 12A:
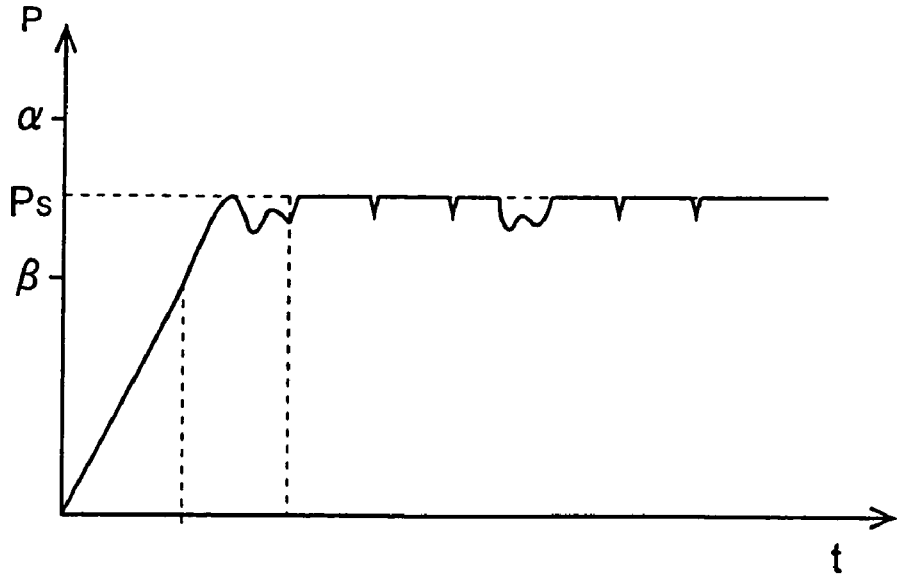
FIG. 12*a* is an operating state diagram showing variations in the actual delivery pressure value in the third embodiment.
Figure 12B:
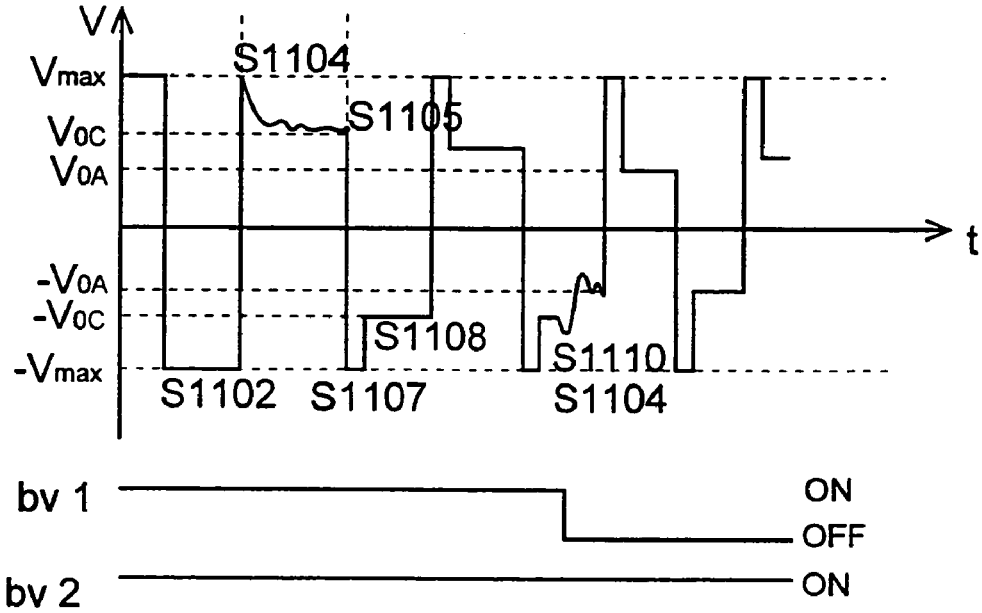
FIG. 12*b* is an operating state diagram showing variations in the feed rate of the plungers in the third embodiment.

Since the liquid pressurizing device of the third embodiment includes the two nozzles, there are three different combinations of injection state and suspension state and the optimum feed rate of the plungers differs depending on these states. Here, it is assumed that $Vo_A$ represents the optimum feed rate of the plungers when the first valve corresponding to the first nozzle is in its ON-state or injection state and the second valve corresponding to the second nozzle is in its OFF-state or suspension state, $Vo_B$ represents the optimum feed rate when the first valve for the first nozzle is in its OFF-state and the second valve for the second nozzle is in its ON-state, and $Vo_C$ represents the optimum feed rate when both of the first and second valves are in the ON-state. The pressure control of the control unit 25 in these cases will be described on the basis of the flow chart shown in FIG. 11 with reference only to those portions which are different from the flow chart of FIG. 9. Further, FIG. 12*a* is an operating state diagram showing the time t and the variations with time of the actual delivery pressure value P, and FIG. 12*b* is an operating state diagram showing the time t and the variations with time of the feed rate V of the plungers 5A and 5B in correspondence to the respective steps in FIG. 11. Also, in FIG. 12*b* bv1 shows the variations with time of the ON/OFF states of the first valve and bv2 shows the variations with time of the ON/OFF states of the second valve.

When the plungers are moved at the maximum feed rate Vmax so that the delivery pressure value exceeds Ps−β and thus, after the previously mentioned proportional control, the optimum feed rate is to be determined (S1105), the optimum feed rate for the existing injection or suspension state of each of the nozzles (any one of $Vo_A$, $Vo_B$ and $Vo_C$) is determined as the optimum feed rate Vo. Taking the case of FIG. 11, for example, both of the first and second valves are in ON-state and therefore the optimum feed rate $Vo_C$ is determined.

Then, differing from the second embodiment, it is determined whether any change in the states (bv-STS) of the valves corresponding to the two nozzles has taken place while moving the plungers at the then current optimum feed rate (S1109; bv-STS CHNG). Thus, if there has been a change, it is determined whether the optimum feed rate (CHNG Vo) of the plungers corresponding to the states of the valves after the change has already been determined (S1110); f it is, the feed rate V is changed to the optimum feed rate (CHNG Vo) following the change (S1111). If the optimum feed rate (CHNG Vo) of the plungers corresponding to the states of the valves after the change has not been determined, in the like manner as the previously mentioned proportional control, the plungers are moved one stroke and the feed rate at the first stroke ends (STRK-End) is detected, thereby changing the feed rate to the detected feed rate and using it as the optimum feed rate Vo (S1110,S1103, S1104, S1105).

In the case of FIGS. 12*a* and 12*b*, there has been a change from the state in which both of the valves were in ON-state to the state in which the first valve is in its OFF-state and the second valve is in its ON-state so that the optimum feed rate is changed from $Vo_C$ to $Vo_A$ by the proportional control.

Figure 13A:
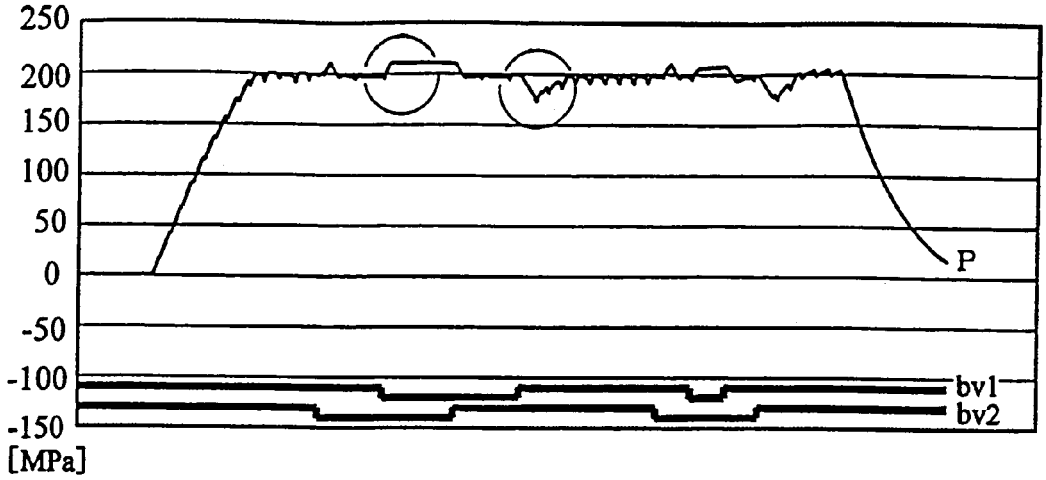
FIG. 13*a* is an explanatory diagram showing pressure variations for the actual delivery pressure value in a conventional liquid pressurizing device.
Figure 13B:
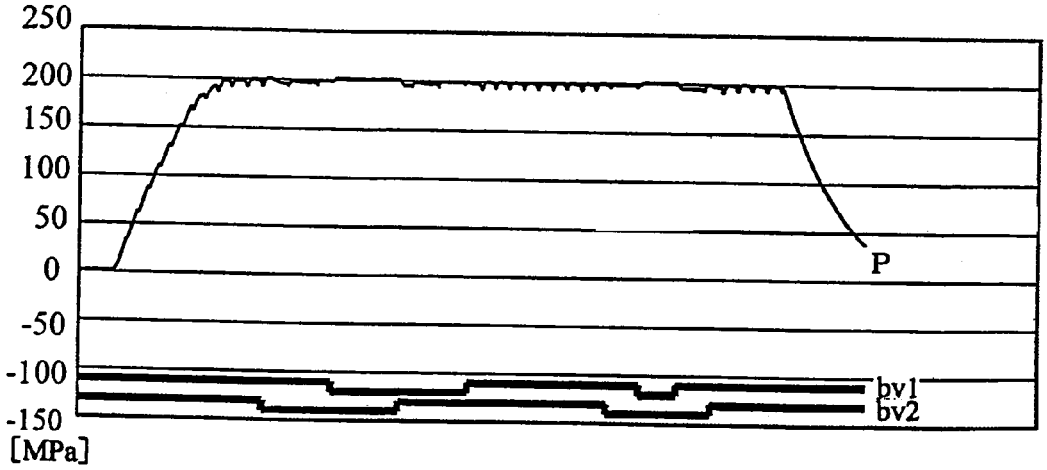
FIG. 13*b* is an explanatory diagram showing pressure variations for the actual delivery pressure value in the liquid pressurizing device of the third embodiment.
Figure 13C:
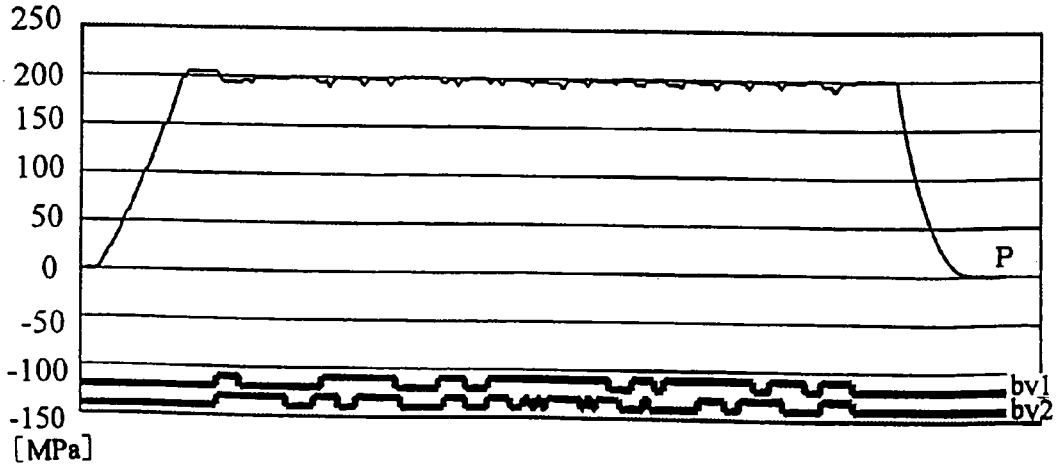
FIG. 13*c* is an explanatory diagram showing pressure variations for the actual delivery pressure value when ON-OFF operations of the valves are effected frequently in the liquid pressurizing device of the third embodiment.

Then, FIGS. 13*a* to 13*c* show operating state diagrams comparing the pressure variations of the actual delivery pressure value P by the pressure control of a conventional device with the pressure variations of the actual delivery pressure value P by the pressure control of the liquid pressurizing device according to the third embodiment. FIG. 13*a* shows the operating state diagram of the conventional device in which there is no input from its two ON-OFF valves (bv1, bv2). As will be seen from FIG. 13*a*, both the pressure drop when both the two valves are in ON-state and the pressure overshoot when both the two valves are in OFF-state are so conspicuous and the pressure value is not stable.

On the contrary, FIGS. 13*b* and 13*c* are the operating state diagrams of the pressure variations by the device according to the third embodiment which performs the pressure control by receiving the inputs from its two ON-OFF valves (bv1, bv2). While FIG. 13*c* also represents the case of the third embodiment, it shows in particular the pressure variations when the two ON-OFF valves are turned on and off more frequently.

As will be seen from FIGS. 13*b* and 13*c*, in accordance with the liquid pressurizing device of the present embodiment, even if the two nozzles are used, the proportional control is performed again so that the current optimum feed rate is changed to the optimum feed rate corresponding to the state after the change, thus making it possible to always maintain the optimum feed rate of the plungers corresponding to the injection and susupension states of the nozzles, prevent pressure variations of the actual delivery pressure value and maintain the stable state. Particularly, as shown in FIG. 13*c*, the pressure variations can be reduced very greatly even if the ON-OFF valves are turned on and off frequently.

It is to be noted that while the liquid pressurizing devices of the above-described embodiments have been shown as applied to the nozzle apparatus adapted, for example, to cut materials or the like by the injection of a high pressure liquid, it is arbitrary to apply them, for example, to such devices adapted for pressure treatment of foodstuff in a food pressure treating pressure container of a given volume to which a high pressure liquid is supplied.

What is claimed is:

1. A liquid pressurizing device comprising:

a reciprocating pump for pressurizing and delivering a high pressure liquid through reciprocating motion of a plurality of plungers;

rotary servo motor means for driving the reciprocating motion of the plurality of plungers;

pressure measuring means for measuring an actual delivery pressure value of said high pressure liquid;

pressure control means for adjusting a feed rate of reciprocating motion of said plungers so that the actual delivery pressure value measured by said pressure measuring means is converged to a preset pressure value as a desired value;

means to compare the measured actual delivery pressure value with a predetermined threshold which is close to and lower than said preset pressure value;

means to control the reciprocating motion of the plurality of plungers through said rotary servo motor means depending on the result of the comparison to make the actual delivery pressure value reach the predetermined threshold if the threshold has not been reached;

means to determine the feed rate as an optimum feed rate of the reciprocating motion of the plurality of plungers when the threshold is reached; and means to control the feed rate of the reciprocating motion of the plurality of plungers through said rotary servo motor means at said optimum feed rate after the threshold has been reached.

2. A liquid pressurizing device according to claim 1, wherein said pressure control means comprises a proportional control means for performing, after the actual delivery pressure value has reached the predetermined threshold, the proportional control of the actual delivery pressure value during a time taken for the plungers to first reach an end of a forward stroke.

3. A liquid pressurizing device according to claim 2, wherein said pressure control means further comprises means to correct the feed rate on the basis of the deviation between the actual delivery pressure value and said preset pressure value when the direction of the reciprocating motion of the plungers is changed after said optimum feed rate has been determined.

4. A liquid pressurizing device according to claim 3, wherein said pressure control means further comprises means to temporarily set the feed rate to a rate higher than said optimum feed rate when the direction of reciprocating motion of the plurality of plungers is changed after said optimum feed rate has been determined.

5. A liquid pressurizing device according to claim 2, wherein said pressure control means further comprises means to temporarily set the feed rate to a rate higher than said optimum feed rate when the direction of reciprocating motion of the plurality of plungers is changed after said optimum feed rate has been determined.

6. A liquid pressurizing device according to claim 1, wherein said pressure control means further comprises means to correct the feed rate on the basis of the deviation between the actual delivery pressure value and said preset pressure value when the direction of the reciprocating motion of the plurality of plungers is changed after said optimum feed rate has been determined.

7. A liquid pressurizing device according to claim 6, wherein said pressure control means further comprises means to temporarily set the feed rate to a rate higher than said optimum feed rate when the direction of reciprocating motion of the plungers is changed after said optimum feed rate has been determined.

8. A liquid pressurizing device according to claim 1, wherein said pressure control means further comprises means to temporarily set the feed rate to a rate higher than said optimum feed rate when the direction of reciprocating motion of the plungers is changed after said optimum feed rate has been determined.

9. A liquid pressurizing device comprising:

a reciprocating pump for pressurizing arid delivering a high pressure liquid through the reciprocating motion of a plurality of plungers;

pressure measuring means for measuring an actual delivery pressure value of said high pressure liquid;

a nozzle for injecting said high pressure liquid;

pressure control means for adjusting the feed rate of reciprocating motion of said plungers so that the actual delivery pressure value measured by said pressure measuring means is converged to a preset pressure value as a desired value;

detecting means for detecting an injection state and a suspension state of said high pressure liquid from said nozzle;

means for determining an optimum feed rate of the reciprocating motion of the plurality of plungers after the actual delivery pressure value reaches a predetermined threshold; and means for maintaining the feed rate of the reciprocating motion of the plurality of plungers at said optimum feed rate, wherein said pressure control means is responsive to the detection of the suspension state by said detecting means to stop the movement of said plungers when said preset pressure value is nearly reached.

10. A liquid pressurizing device according to claim 9, wherein said pressure control means is responsive to the detection of the suspension state by said detecting means to stop the movement of said plungers and is responsible to the detection of a reinjection by said detecting means to effect the movement of said plungers at said optimum feed rate.

11. A liquid pressurizing device comprising;

a reciprocating pump for pressurizing and delivering a high pressure liquid through the reciprocating motion of a plurality of plungers;

pressure measuring means for measuring the actual delivery pressure value of the high pressure liquid;

a plurality of nozzles for injecting the high pressure liquid;

pressure control means for adjusting the feed rate of reciprocating motion of the plungers so that the actual delivery pressure value measured by said pressure measuring means is converged to a preset pressure value as a desired value; and detecting means for detecting an injection state and a suspension state of the high pressure liquid from each of said nozzles;

means for determining an optimum feed rate of the reciprocating motion of the plungers with the control operation of the actual delivery pressure value after reaching a predetermined threshold; and means for maintaining the feed rate of the reciprocating motion of the plungers constant at said optimum feed rate, wherein said pressure control means is responsive to the detection of any change between said injection state and suspension state of each of said nozzles by said detecting means so that the feed rate of the reciprocating motion of said plungers is changed to the optimum feed rate corresponding to the injection state and suspension state of each of said nozzles after the change between the injection state and suspension state.

* * * * *